United States Patent [19]

Braun

[11] Patent Number: 4,980,524

[45] Date of Patent: Dec. 25, 1990

[54] KEY SWITCH OPERABLE BY A CYLINDER LOCK

[75] Inventor: Peter B. Braun, Bornheim, Fed. Rep. of Germany

[73] Assignee: Dom-Sicherheitstechnik G.m.b.H. & Co. KG, Fed. Rep. of Germany

[21] Appl. No.: 181,627

[22] Filed: Apr. 14, 1988

[30] Foreign Application Priority Data

Apr. 23, 1987 [DE] Fed. Rep. of Germany ..... 8705889

[51] Int. Cl.[5] ..... H01H 27/00

[52] U.S. Cl. ..... 200/43.08; 200/43.11; 200/305

[58] Field of Search ..... 200/43.08, 43.03, 295, 200/305, 43.01, 43.04, 43.11

[56] References Cited

U.S. PATENT DOCUMENTS 1,936,163 11/1933 Jacobi ..... 200/43.08
4,405,843 9/1983 Wolniak et al. ..... 200/43.08
4,639,562 1/1987 Fredrickson ..... 200/43.08
4,673,776 6/1987 Samburskv ..... 200/43.08
4,707,575 11/1987 Krasik ..... 200/276

*Primary Examiner*—Henry J. Recla
*Assistant Examiner*—Glenn T. Barrett
*Attorney, Agent, or Firm*—Barry E. Deutsch; J. Bruce Hoofnagle

[57] ABSTRACT

A key switch operable by a cylinder lock, which switch comprises a cylinder housing and a cylinder core arranged to be rotatable within the housing, which is coupled with a non-conducting switch rotor and a switch casing base, in which the switching arrangement is located and the switch rotor is guided.

The cylinder housing is made of insulating material and forms the top of the switch casing and, on its end face facing the switch rotor, has at least one annular rib which is concentric with the axis of the switch rotor, and which engages in an annular groove of the switch rotor, which groove has a corresponding contour.

11 Claims, 1 Drawing Sheet

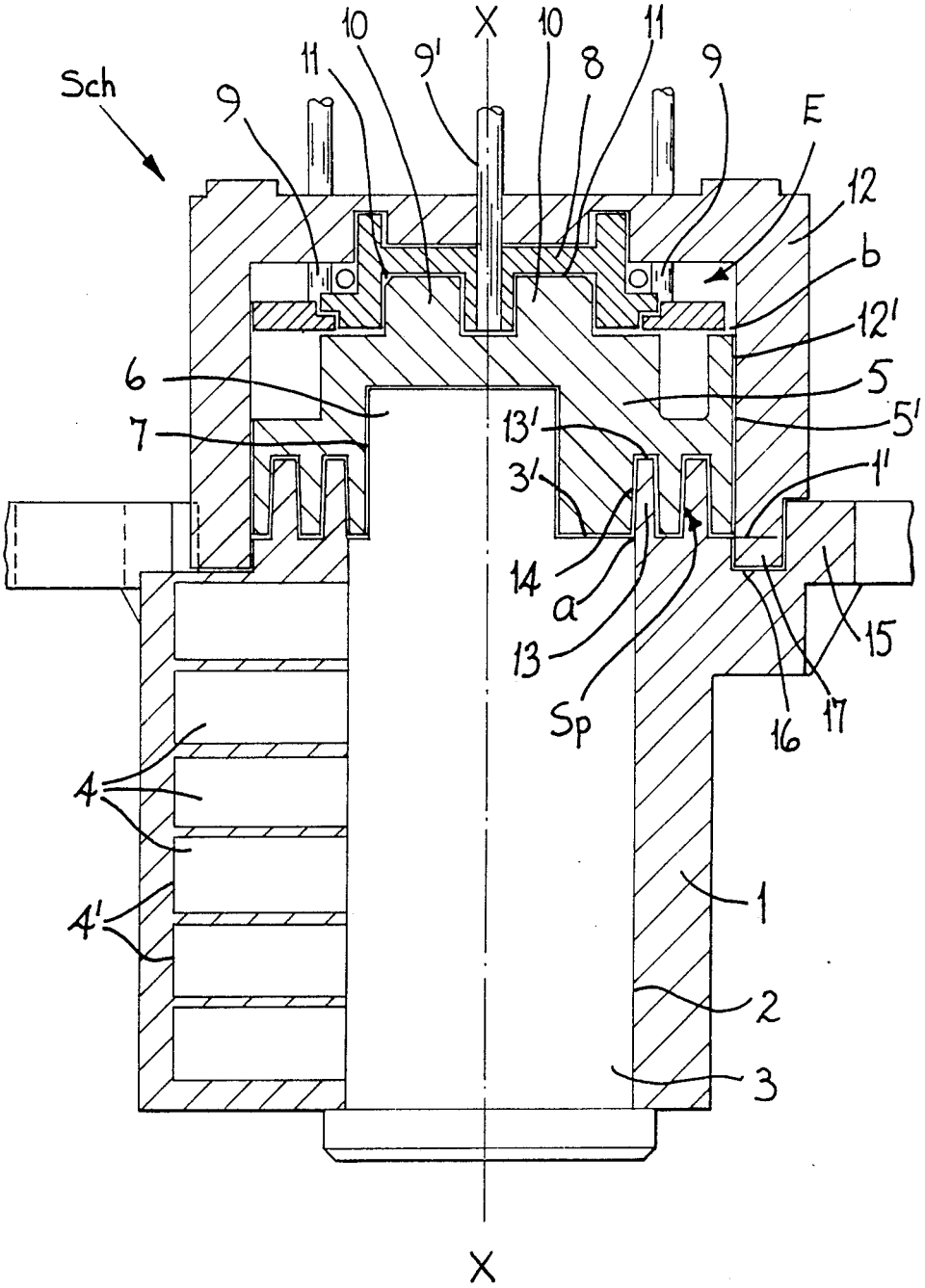
Sch
9
11
10
9'
X
10
8
11
9
E
12
b
12'
6
5
7
13'
5'
3'
1'
14
a
13
Sp
15
16
17
4
4'
1
2
3
X

KEY SWITCH OPERABLE BY A CYLINDER LOCK

BACKGROUND OF THE INVENTION

The present invention relates to a key switch operable by a cylinder lock comprising a cylinder housing and a cylinder core arranged to be rotatable within the housing, which is coupled with a non-conducting switch rotor, as well as a switch casing base, in which the switching arrangement is located and the switch rotor is guided.

Key switches of this kind are increasingly fitted to electronic equipment in order to prevent unauthorized access or to maintain control. Owing to the high electrostatic potential of a person relative to earth, the insertion of the key can result in a flash-over from the cylinder lock to the fixed contacts of the switching arrangement. The result is then usually malfunctioning of the electronic equipment, since the fixed contacts, in particular those connected to integrated circuits, cannot cope with the resultant loads. For this reason, even the cylinder housing has been provided with an insulating plastic casing and the switching side has been put into a switch rotor of a cup-shaped design which is open-ended towards the key side, which is itself similarly enveloped by a cup-shaped casing cap which is also of insulating material. This particular solution however results in increased size of the switch. This is, however, the only practical means by which the insulation effect can be attained.

SUMMARY OF THE INVENTION

An object of the present invention is to provide a key switch of this kind, operable by a cylinder lock which provides optimum insulation effect by simple means in a compact arrangement.

The present invention provides a key switch which is operable by a cylinder lock, which switch comprises a cylinder housing and a cylinder core arranged to be rotatable within the housing, which is coupled with a non-conducting switch rotor and a switch casing base, in which the switching arrangement is located and the switch rotor is guided, characterized in that the cylinder housing is made of insulating material and forms the top of the switch casing and, on its end face facing the switch rotor, has at least one annular rib which is concentric with the axis (x-x) of the switch rotor, which rib engages in an annular groove of the switch rotor, which groove has a corresponding contour.

As a result of this design a key switch of this type is obtained which has increased reliability. Although the key switch is of compact construction, high flash-over stability is established. Because of the construction, in practice the switching takes place in the cross-sectional area which forms the cylinder housing. The key switch according to the invention comprises a cylinder housing which consists of insulating material and forms the top section of the switch casing and has on its end face facing the switch rotor, at least one annular rib concentric with the axis of the switch rotor, which engages in an annular groove of the switch rotor which annular groove has a corresponding contour. This results not only in a relatively long air gap and thus an extended flash-over path, but also to a component for the additional guiding of the switch rotor. Further, it has proved to be advantageous, that the cylinder core engages in an interlocking recess of the switch rotor by means of an extension departing from its inner end face, so that the annular rib rises from approximately the same level as the end face. This design results in the utilization of the switch space which is in any case located in front of the end face of the cylinder housing. The annular rib preferably thus extends over an axial portion of the length of the extension. Since the extension extends behind the cross section of the cylinder core because of the formation of driving faces, the space it provides can be used by the switch rotor and also for forming the extended path. In order to obtain optimum utilization of the space, it is preferred that the height of the annular rib is greater than its width. From the manufacturing point of view, as well as for the fitting it is further preferred that the annular rib is conically reduced towards the crest of the rib. By choosing an equal flank angle, seen in cross section, a trapezoidal shape as seen in cross section, results. To provide a still wider air gap as the flash-over passage, two concentric annular ribs are formed on the cylinder housing, which engage in two corresponding annular grooves of the switch rotor. With the height of the ribs and the depth of the grooves being the same, a kind of meander-shaped air gap is thus established between the lock housing on the one hand and the switch rotor on the other hand. Finally it has provided to be additionally advantageous that the base of the switch casing is designed in the form of a cup and with its cup-shaped collar engages at least over a partial circumference into a matching concentric annular groove provided on the end face of the cylinder housing forming the top of the switch casing. Locking means may also be formed within this area, which make it possible for the components forming the switch to be joined together axially in a simple way.

The invention will now be described below in more detail with reference to the accompanying drawing:

BRIEF DESCRIPTION OF THE DRAWINGS

The drawing shows a longitudinal view through the center of an embodiment of a key switch operable by a cylinder lock according to the invention.

DETAILED DESCRIPTION OF THE DRAWINGS

The key switch Sch has a cylinder housing 1 made from an insulating material, for example a synthetic material.

The cylinder housing 1 is provided with an eccentrically lying longitudinal bore 2. The bore 2 houses a cylinder core 3 which is rotatably mounted within the bore 2.

The cylinder core 3 is provided with a key channel (not show in detail), into which a key can be inserted. The key is a flat key, which is profiled on its broadside. The key channel has a corresponding counter profile. At the narrow side remote from the back of the key the key has locking notches. These arrange in proper order core pins, onto which bear housing pins. The pins are adjusted with the appropriate key so that the faces of the facing pin align with the joint between longitudinal bore 2 and the circumference of the cylinder core 3. The cylinder core 3 can then be turned by means of the key.

The housing pins are loaded by compression springs housed inside the bore holes 4 of the cylinder housing 1, which springs abut against the bottom of the holes 4'.

Turning back the cylinder core to its initial position makes it possible for the key to be withdrawn again.

That leads to a cancellation of the adjustment position of the pins and thus to the blocking of the cylinder lock 3.

The key switch Sch operable by a cylinder lock further comprises a switch rotor 5. This is also made from a non-conductive material. It is rotated by the cylinder core 3 into an angular position predetermined by the lock. The rotary drive results from an extension 6 projecting from the inner end face 3' of the cylinder core 3. The extension has a non-circular cross-sectional area and extends off center from the common rotation axis of the cylinder core and/or the switch rotor axis x-x. The extension 6 extends beyond the cross section of the cylinder core 3. The axial length of the extension 6 is approximately a quarter to a fifth of the length of the cylindrical portion of the cylinder core.

The switch rotor 5 has an interlocking recess 7 of a corresponding shape to the cross-sectional area of the extension 6.

The switching arrangement ( of the key switch Sch extends in axial extension of the switch rotor 5. The switch comprises an interspersed indexing disc 8, which is connected to fixed contacts 9, so that it provides, for example, an on/off switch. The fixed contacts 9 are then wired up to integrated circuits of the electronic device, to which the cylinder lock Sch is assigned.

The angular-restricted rotary drive of the indexing disc 8, which contacts either the one or other fixed contact, is effected over a central bifurcated projection of the switch rotor 5. Its prongs 10 engage for rotary drive into form-conforming recesses 11 of the indexing disc 8, which has a center contact 9'.

In order to avoid a flash-over to the device provided for example with integrated circuits, because of electrostatic potential of the attendant who inserts the key into the cylinder lock, the separating line between the cylinder housing 1 made of insulating material, and the switch rotor 5 also made of insulating material is enlarged in order to obtain as wide a gap as possible between the inner end of the cylinder housing 1 and the switching arrangement E, which is itself encompassed by the base 12 of a switch casing also of non-conducting material, and of which the cylinder housing 1 represents in practice the top of the switch casing. In practice it therefore follows that the cylinder housing 1 has on its end face 1' facing the switch rotor 5 at least one annular rib 13 concentric with the switch rotor axis x-x, which engages in an annular groove 14, with a corresponding contour of the switch rotor 5. In the embodiment shown in the accompanying drawing two radially spaced annular ribs 13 depart from the end face 1' of the cylinder housing 1, although more than two can be provided if this is required. All of the annular ribs 13 are, as seen in cross section, designed in a trapezoidal form in which the broader trapezoidal area, that is the base, is attached to the end face 1' of the cylinder housing 1. The end face 1' lies perpendicular to the axis of rotation of the cylinder core and/or switch rotor axis x-x. The additional annular ribs 13 engage in annular grooves 14 with a corresponding contour. By leaving a uniform air gap Sp the flank angle of the grooves 14 is matched to that of the rotationally symmetrical annular ribs 13.

As can be seen, the annular ribs 13 extend over an axial portion of the length of the extension 6. The height of the ribs is equivalent to approximately half of the axial length of the extension. The height of the annular rib 13 is greater than its width, suitably by a ratio of approximately 4:1.

The inner annular rib 13 starts to rise at the level of the end of the longitudinal bore 2 for the cylinder core 3, so that the annular rib 13 rises at approximately the same level as the end face 3' of the cylinder core 3. It follows that the inner end face 3' of the cylinder core 3 extends coplanar with the inner end face 1' of the cylinder housing 1.

The two annular ribs 13 lie just within the base housing cross section of the cylinder housing 1. In the intersecting region between the cylinder housing 1 and the casing base 12 the housing 1 extends into an outwardly directed mounting collar 15 for attaching the lock cylinder and/or key switch Sch to the apparatus housing. The end of the cylinder housing 1 facing the casing base 12 forms an annular groove 16, in which the cup-shaped collar 17 engages the cup-shaped designed casing base 12 which has a corresponding contour. In the external zone reproduced in the drawing on the LH-side the groove is opened up outwardly. In front of the cylindrical inner wall 12' of the casing base 12, the cylindrical outer wall 5' of the switch rotor 5 extends, while leaving an annular clearance. This outer wall 5' is in part axially advanced extending up into the region of the switching arrangement E and at a short distance from the indexing disc 8.

The section of the switch rotor 5 forming the cylindrical outer wall 5' is advanced up to close in front of the end face 1' of the cylinder housing 1 facing the switch rotor 5. From this arrangement a meander-shaped air gap Sp is formed between the components 1, 5 and 12. The meander shape extends further in the direction of the cylinder core 3, so that the switch rotor 5 fills the region of the cylinder core 3 removed to create the extension 6. Because of the offset arrangement of the extension 6 these regions vary in width. The projection at the left hand side defining the annular groove 14 there is of a thickness which is equal to that of an annular rib 13. The beginning of the air gap Sp is in the region of the outer edge of the inner end face 1'. Its termination b lies at the end of the cylindrical cleaving split between the inner wall 12' and the outer wall 5' of the switch rotor 5. At the left hand side, the termination of the air gap is somewhat further away from the switching arrangement E. Axial securing of the cylinder core 3 can be carried out by the clip fasteners, either to the cylinder housing 1 or the rotor 5.

I claim:

1. A key switch operable by a cylinder lock comprising:

a one piece cylinder housing;

a cylinder core rotatably mounted within said housing;

a nonconducting switch rotor connected directly to said core and rotatable therewith;

a nonrotatable switch casing base including switch contact means;

said housing and said base sandwiching said nonconducting rotor therebetween; and said housing being made of insulating material and including at least one annular rib extending from an end face facing said rotor, the longitudinal axis of said annular rib being concentric with the axis about which said rotor rotates, said rotor having at least one groove, with said rib being located and completely encompassed within said groove and said rib being rotatable within said groove.

2. A key switch according to claim 1, wherein said cylinder core engages in an interlocking recess of said switch rotor, by means of an extension on its inner end face so that said annular rib rises from approximately the same level as the end face.

3. A key switch according to claim 2 wherein said annular rib extends over an axial portion of the length of said extension.

4. A key switch according to claim 3 where the height of said annular rib is greater than its width.

5. A key switch according to claim 4 where said annular rib is conically reduced towards the crest of the rib.

6. A key switch according to claim 5 wherein said annular rib is trapezoidal in cross-sectional area.

7. A key switch according to claim 6 wherein two concentric annular ribs are formed on said cylinder housing, which ribs engage in two corresponding annular grooves of said switch rotor.

8. A key switch according to claim 7 wherein the base of said switch casing is cup-shaped and, includes a cup-shaped collar, engages over at least a partial circumference into a matching concentric annular groove provided on the end face of said cylinder housing forming the top of said switch casing.

9. A key switch according to claim 1, which further comprises means for providing an extended flash-over path between said housing and said switch rotor.

10. A key switch according to claim 9 wherein said providing means includes a predefined air gap between said housing and said switch rotor.

11. A key switch according to claim 10 wherein said predefined air gap is formed as a meander-shaped air gap.

* * * * *